US006896389B1

(12) United States Patent
Paul

(10) Patent No.: US 6,896,389 B1
(45) Date of Patent: May 24, 2005

(54) HEADMOUNTED LIGHT

(76) Inventor: Erby Paul, 5720 Beverley Rd., Brooklyn, NY (US) 11203

( * ) Notice: Subject to any disclaimer, the term of this patent is extended or adjusted under 35 U.S.C. 154(b) by 0 days.

(21) Appl. No.: 10/646,049

(22) Filed: Aug. 22, 2003

(51) Int. Cl.[7] ..... F21V 21/084
(52) U.S. Cl. ..... 362/105; 362/106
(58) Field of Search ..... 362/103, 105, 362/106, 572, 573, 574, 575, 570; 2/209.13, 2/422, 906

(56) References Cited

U.S. PATENT DOCUMENTS 2,304,367 A * 12/1942 Meyer et al. ..... 362/106
3,285,242 A * 11/1966 Wallace ..... 362/105
3,745,993 A * 7/1973 Feinbloom ..... 362/105
5,115,382 A * 5/1992 Smith ..... 362/105

* cited by examiner

*Primary Examiner*—Y. My Quach-Lee

(57) ABSTRACT

Headmounted lights provide a hands-free source of illumination without tethering the user to external equipment. A power source, on/off switch, and light source are enclosed by a housing that is removably attached to a belt by a pouch. A fiber-optic cable transmits light from the light source to a headband-mounted lens assembly. The lens assembly can be aimed via an adjustable mount that connects a reflector and lens to the front of the headband. The size of the headband can be adjusted by a friction locking mechanism attached to its rear. The headband has both a horizontal portion and a vertical portion. Headband protrusions extend from the vertical portion. Clips removably attach the fiber-optic cable to the headband and the belt.

13 Claims, 2 Drawing Sheets

HEADMOUNTED LIGHT

BACKGROUND OF THE INVENTION

1. Field of the Invention

The present invention relates to a headmounted light for use in connection with illumination. The headmounted light has particular utility in connection with providing a hands-free source of illumination without tethering the user to external equipment.

2. Description of the Prior Art

Headmounted lights are desirable for providing a hands-free source of illumination without tethering the user to external equipment. Surgeons typically use headmounted lights when performing operations. Traditional designs require the user to connect the headmounted light to an external light source. This greatly limits the user's freedom of movement during use: either the external light source has to move with the user, or the user has to unplug from the external light source. The latter situation is particularly disadvantageous since the headmounted light no longer provides illumination when unplugged. Headmounted lights of the current invention eliminate this inconvenience by providing a light source that attaches to the user along with a headband-mounted lens assembly. The invention allows the user to move freely without any need to maintain a connection to an external light source.

The use of battery power and light belts is known in the prior art. For example, U.S. Pat. No. 6,260,978 to St. John discloses a battery power and light belt. However, the St. John '978 patent does not have a fiber-optic cable, and has further drawbacks of lacking an adjustable mount for the light.

U.S. Pat. No. 4,298,913 to Lozar discloses an illuminating apparatus that mounts on the body of a person. However, the Lozar '913 patent does not have a fiber-optic cable, and additionally does not have an adjustable mount for the light.

Similarly, U.S. Pat. No. 3,830,230 to Chester discloses a surgical headlamp that permits several degrees of freedom of movement of a high-intensity headlight with respect to a headband worn by a user. However, the Chester '230 patent does not have a power source, and cannot emit light without being connected to an external light source.

In addition, U.S. Pat. No. Des. 399,580 to Feinbloom discloses a deluxe surgical head light that attaches to a user's head. However, the Feinbloom '580 patent does not have a fiber-optic cable, and also does not have a light source.

Furthermore, U.S. Pat. No. 5,430,620 to Li et al. discloses a compact surgical illumination system capable of dynamically adjusting the resulting field of illumination that provides illumination. However, the Li et al. '620 patent does not emit light without being connected to an external light source, and further lacks a power source.

Lastly, U.S. Pat. No. 6,224,227 to Klootz discloses a surgical headlight assembly with detachable video-camera module that allows viewers at a remote location to observe an operation procedure on a video monitor from a surgeon's visual perspective. However, the Klootz '227 patent does not have a power source, and has the additional deficiency of requiring a connection to an external light source in order to emit light.

While the above-described devices fulfill their respective, particular objectives and requirements, the aforementioned patents do not describe a headmounted light that allows providing a hands-free source of illumination without tethering the user to external equipment. The St. John '978 patent, the Lozar '913 patent, and the Feinbloom '580 patent make no provision for a fiber-optic cable. The St. John '978 patent and the Lozar '913 patent lack an adjustable mount for the light. The Chester '230 patent, the Li et al. '620 patent, and the Klootz '227 patent cannot emit light without being connected to an external light source. The Chester '230 patent, the Li et al. '620 patent, and the Klootz '227 patent do not have a power source. The Feinbloom '580 patent lacks a light source.

Therefore, a need exists for a new and improved headmounted light that can be used for providing a hands-free source of illumination without tethering the user to external equipment. In this regard, the present invention substantially fulfills this need. In this respect, the headmounted light according to the present invention substantially departs from the conventional concepts and designs of the prior art, and in doing so provides an apparatus primarily developed for the purpose of providing a hands-free source of illumination without tethering the user to external equipment.

SUMMARY OF THE INVENTION

In view of the foregoing disadvantages inherent in the known types of battery power and light belts now present in the prior art, the present invention provides an improved headmounted light, and overcomes the above-mentioned disadvantages and drawbacks of the prior art. As such, the general purpose of the present invention, which will be described subsequently in greater detail, is to provide a new and improved headmounted light which has all the advantages of the prior art mentioned heretofore and many novel features that result in a headmounted light which is not anticipated, rendered obvious, suggested, or even implied by the prior art, either alone or in any combination thereof.

To attain this, the present invention essentially comprises a headband with a lens assembly connected to its front. A light source is connected to the lens assembly by a light transmitter.

There has thus been outlined, rather broadly, the more important features of the invention in order that the detailed description thereof that follows may be better understood and in order that the present contribution to the art may be better appreciated.

The invention may also include the light transmitter being a fiber-optic cable. The light source may comprise a light emitter with a connected power source. The light emitter may be a light bulb or a light emitting diode. The power source may be a battery or a fuel cell. The battery may be rechargeable. The headband may comprise a horizontal portion with its front and rear attached to the opposing ends of a vertical portion. There may be a headband protrusion with one end attached to the middle of the vertical portion. There may be a hollow pouch removably enclosing the light source. There may be a belt attached to the side of the pouch. There may be a side release buckle removably connecting the opposing ends of the belt. There may be a clip attached to the middle of the vertical portion. The lens assembly may comprise a lens, a reflector enclosing the lens, and an adjustable mount connecting the rear of the reflector to the front of the headband. There may be a strap with one end attached to the middle of the belt and its opposing end removably attached to the opposing side of the pouch by a hook and loop fastener. There may be a switch hole in the opposing side of the pouch. There may be an on/off switch connected to the light emitter and the power source. The light emitter, on/off switch, and power source may be enclosed by a housing. There may be a clip attached to the middle of the belt. There may be connectors attached to the opposing ends of the fiber-optic cable. The light source and the lens assembly may be removably connected by the connectors to the fiber-optic cable. There may be a buckle removably connecting the opposing ends of the belt. There may be a size adjuster attached to the rear of the headband. The size adjuster may be a friction locking mechanism. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved headmounted light that has all of the advantages of the prior art battery power and light belts and none of the disadvantages.

It is another object of the present invention to provide a new and improved headmounted light that may be easily and efficiently manufactured and marketed.

An even further object of the present invention is to provide a new and improved headmounted light that has a low cost of manufacture with regard to both materials and labor, and which accordingly is then susceptible of low prices of sale to the consuming public, thereby making such headmounted light economically available to the buying public.

Still another object of the present invention is to provide a new headmounted light that provides in the apparatuses and methods of the prior art some of the advantages thereof, while simultaneously overcoming some of the disadvantages normally associated therewith.

Even still another object of the present invention is to provide a headmounted light for providing a hands-free source of illumination without tethering the user to external equipment. This allows the user to have complete freedom of movement while using the headmounted light.

Still yet another object of the present invention is to provide a headmounted light for providing a hands-free source of illumination without tethering the user to external equipment. This makes it possible to adjust the size of the headband.

An additional object of the present invention is to provide a headmounted light for providing a hands-free source of illumination without tethering the user to external equipment. This improves the user's comfort level when wearing the headband.

A further object of the present invention is to provide a headmounted light for providing a hands-free source of illumination without tethering the user to external equipment. This allows the user to switch the light source on and off.

Lastly, it is an object of the present invention to provide a new and improved headmounted light for providing a hands-free source of illumination without tethering the user to external equipment.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
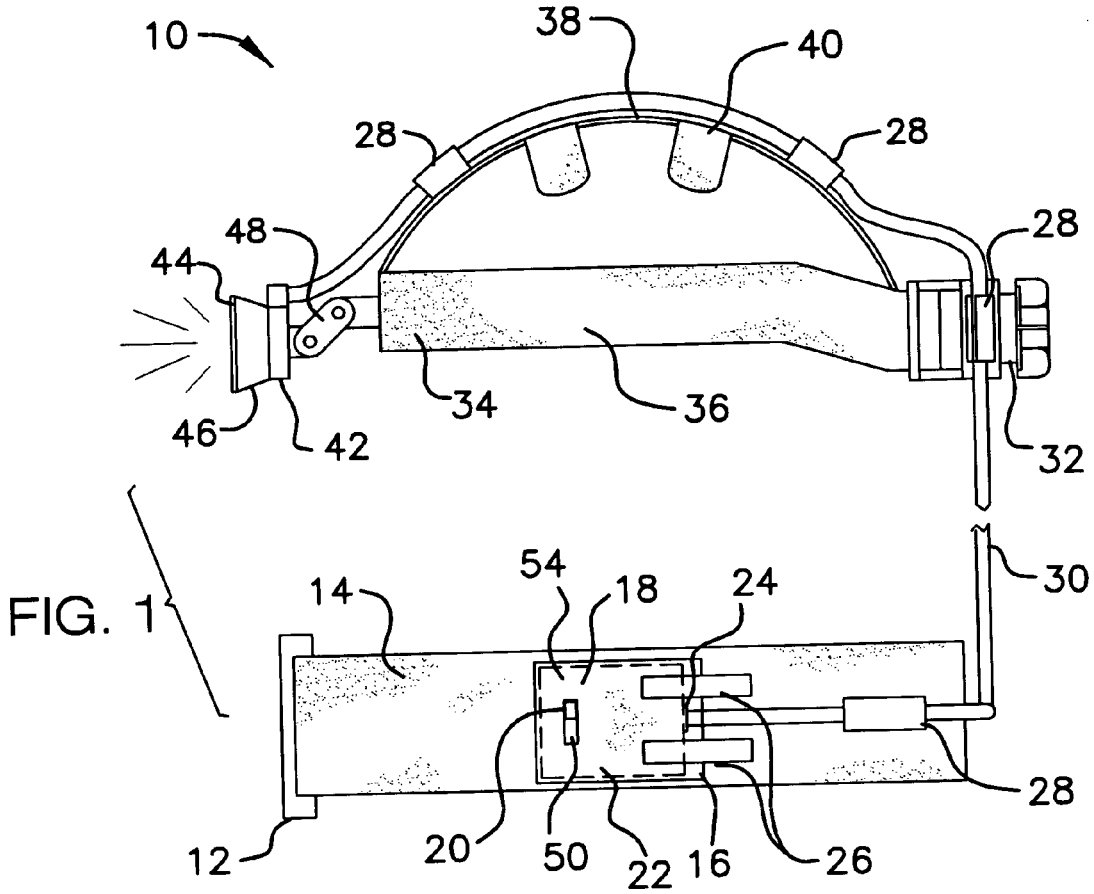
FIG. 1 is a left side view of the current embodiment of the headmounted light constructed in accordance with the principles of the present invention.

Referring now to the drawings, and particularly to FIGS. 1–4, a current embodiment of the headmounted light of the present invention is shown and generally designated by the reference numeral 10.

In FIG. 1, a new and improved headmounted light 10 of the present invention for providing a hands-free source of illumination without tethering the user to external equipment is illustrated and will be described. More particularly, the headmounted light 10 has a side release buckle 12 removably connecting the opposing ends of a belt 14. A pouch 16 has one side attached to the middle of belt 14. The pouch 16 is hollow and has an open end so that it can removably enclose a housing 18. Housing 18 encloses a light source 22, a power source 54, and an on/off switch 20. The opposing side of pouch 16 has a switch hole 50 that allows on/off switch 20 to protrude from pouch 16. In the current embodiment, light source 22 is a light bulb and power source 54 is a rechargeable battery. On/off switch 20 controls the flow of electrical current from power source 54 to light source 22. Housing 18 is removably secured within pouch 16 by straps 26. Light source 22 is connected to lens assembly 42 by fiber-optic cable 30. Fiber-optic cable 30 is removably attached to belt 14 and a headband 34 by clips 28. Lens assembly 42 has a lens 44 enclosed by a reflector 46 and an adjustable mount 48 connecting the rear of the reflector 46 to the front of the horizontal portion 36 of headband 34. The reflector 46 and lens 44 direct light transmitted from fiber-optic cable 30 to the object to be illuminated (not shown). The adjustable mount 48 allows the user to aim the lens assembly 42 to direct light to the desired location. The headband 34 has a vertical portion 38 with its opposing ends attached to the front and rear of the horizontal portion 36. The headband protrusions 40 extend from the middle of the vertical portion 38 and increased the user's comfort level by distributing the weight of the headband 34 over a larger portion of the user's head. A friction locking mechanism 32 attached to the rear of the horizontal portion 36 also increases the user's comfort by allowing the size of the horizontal portion 36 of headband 34 to be adjusted.

Figure 2:
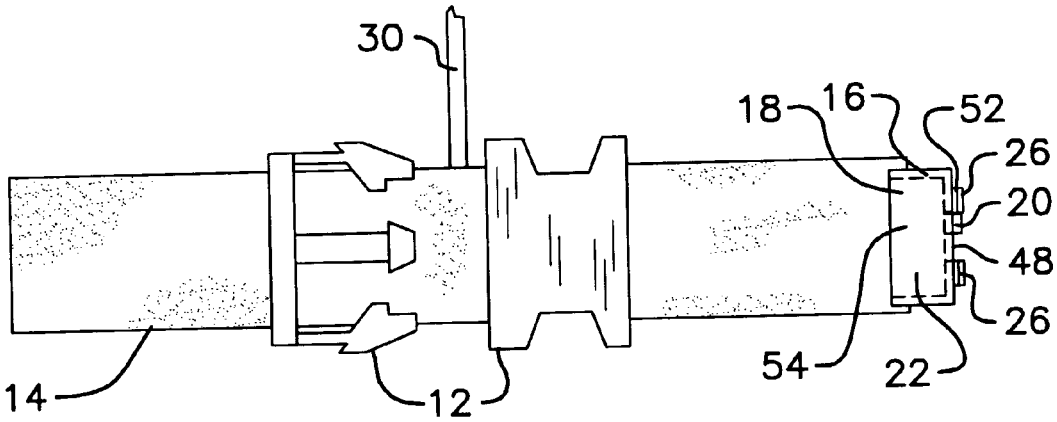
FIG. 2 is a front side view of the belt of the present invention.

Moving on to FIG. 2, a new and improved belt 14 of the present invention for providing a hands-free source of illumination without tethering the user to external equipment is illustrated and will be described. More particularly, the belt 14 has a side release buckle 12 removably connecting its opposing ends. The pouch 16 has one side attached to the middle of belt 14. On/off switch 20 is visible protruding through the switch hole 50 in pouch 16. Hook and loop fasteners 52 are shown removably attaching straps 26 to the opposing side of pouch 16 to removably retain housing 18 within pouch 16. Housing 18 encloses power source 54 and light source 22. Fiber-optic cable 30 is visible extending from belt 14.

Figure 3:
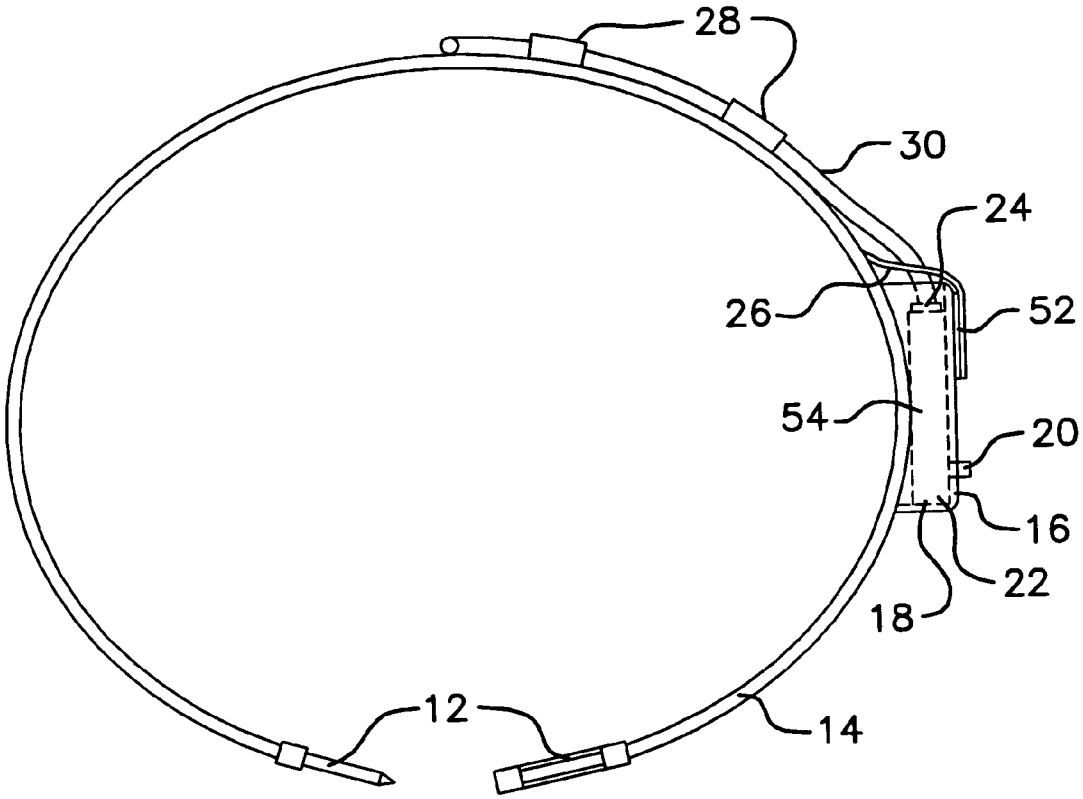
FIG. 3 is a top side view of the belt of the present invention.

Continuing with FIG. 3, a new and improved belt 14 of the present invention for providing a hands-free source of illumination without tethering the user to external equipment is illustrated and will be described. More particularly, the belt 14 has a side release buckle 12 attached to the opposing ends of belt 14. Clips 28 are shown removably attaching fiber-optic cable 30 to belt 14. Connector 24 removably connects one end of fiber-optic cable 30 to light source 22. On/off switch 20 is visible protruding from pouch 16. Hook and loop fastener 52 removably attaches strap 26 to pouch 16. Housing 18 encloses light source 22, power source 54, and on/off switch 20.

Figure 4:
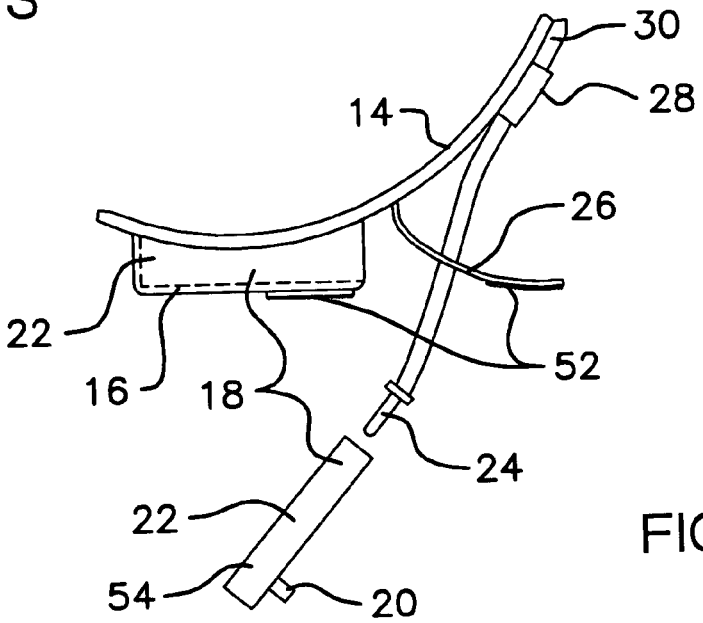
FIG. 4 is a top side view of the pouch of the present invention.

Concluding with FIG. 4, a new and improved pouch 16 of the present invention for providing a hands-free source of illumination without tethering the user to external equipment is illustrated and will be described. More particularly, the pouch 16 has a belt 14 attached to one side of pouch 16. Housing 18 is shown removed from pouch 16. The strap 26 is shown with the hook and loop fastener 52 disengaged so that housing 18 can be removed from pouch 16. The housing 18 encloses on/off switch 20, light source 22, and power source 54. Connector 24 is shown disconnected from light source 22. Clip 28 is visible removably attaching fiber-optic cable 30 to the belt 14.

In use, it can now be understood that the user inserts a charged battery into housing 18 and then places housing 18 into pouch 16 so that on/off switch 20 protrudes from switch hole 50. The straps 26 with hook and loop fasteners 52 are used to retain housing 18 within pouch 16. The user employs side release buckle 12 to secure belt 14 about his or her waist. The user then connects one end of fiber-optic cable 30 using connector 24 to light source 22. The user places headband 34 on their head, and he or she adjusts its size using friction locking mechanism 32. On/off switch 20 is placed in its on position to cause light to be emitted from lens assembly 42. The user can aim the light emitted through lens 44 in the desired direction by adjusting adjustable mount 48. The user switches on/off switch 20 to its off position to turn off light source 22. When the headmounted light 10 is no longer needed, the user removes headband 34 and belt 14.

While a current embodiment of the headmounted light has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable light source such as a light emitting diode may be used instead of the light bulb described. Also, the rechargeable battery may also be a regular battery or a fuel cell. Furthermore, a wide variety of headband size adjustment mechanisms may be used instead of the fraction locking mechanism described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A headmounted light comprising:

a headband having a front, a top, and a rear;

a lens assembly connected to said front of said headband;

a light transmitter having opposing ends with one end connected to said lens assembly; and a light source connected to said opposing end of said light transmitter;

wherein said headband comprises:

a horizontal portion having a front and a rear; and a vertical portion having opposing ends and a middle with said opposing ends attached to said front and said rear of said horizontal portion; and a headband protrusion having opposing ends with one end attached to said middle of said vertical portion.

2. A headmounted light comprising:

a headband having a front, a top, and a rear;

a lens assembly connected to said front of said headband;

a light transmitter having opposing ends with one end connected to said lens assembly; and a light source connected to said opposing end of said light transmitter;

a hollow pouch having an open end and opposing sides removably enclosing said light source;

a belt having opposing ends and a middle with said middle attached to one of said opposing side of said pouch; and a side release buckle removably connecting said opposing ends of said belt.

3. A headmounted light comprising:

a belt having opposing ends and a middle;

a hollow pouch having opposing sides and an open end with one of said opposing sides attached to said middle of said belt;

a light source removably enclosed by said pouch;

a light transmitter having opposing ends with one end connected to said light source;

a lens assembly connected to said opposing end of said light transmitter; and a headband having a front and a back with said front attached to said lens assembly.

4. The headmounted light as defined in claim 3, wherein said lens assembly comprises:

a lens;

a reflector having a rear enclosing said lens; and an adjustable mount having opposing ends with one end connected to said rear of said reflector and said opposing end connected to said front of said headband.

5. The headmounted light as defined in claim 3, further comprising:

a strap having opposing ends with one end attached to said middle of said belt;

a hook and loop fastener removably connecting said opposing end of said strap to other of said opposing sides of said pouch; and a switch hole wherein other of said opposing sides of said pouch defines a hole therein to comprise said switch hole.

6. The headmounted light as defined in claim 3, wherein said light source comprises:

a light emitter;

an on/off switch connected to said light emitter; and a power source connected to said on/off switch.

7. The headmounted light as defined in claim 6, wherein said light emitter, said on/off switch, and said power source are enclosed by a housing.

8. The headmounted light as defined in claim 6, wherein said power source is a rechargeable battery.

9. The headmounted light as defined in claim 3, further comprising a clip attached to said middle of said belt.

10. A headmounted light comprising:

a fiber-optic cable having opposing ends;

a plurality of connectors attached to said opposing ends of said fiber-optic cable;

a light source removably connected by one of said connectors to said end of said fiber-optic cable;

a lens assembly removably connected by one of said connectors to said opposing end of said fiber-optic cable;

a headband having a top, a front, and a rear with said front attached to said lens assembly;

a clip attached to said top of said headband;

a belt having opposing ends and a middle with said middle removably connected to said light source;

a clip attached to said middle of said belt; and a buckle removably connecting said opposing ends of said belt.

11. The headmounted light as defined in claim 10, further comprising a size adjuster attached to said rear of said headband.

12. The headmounted light as defined in claim 11, wherein said size adjuster is a friction locking mechanism.

13. The headmounted light as defined in claim 10, wherein said light source comprises:

a light bulb;

an on/off switch connected to said light bulb; and a rechargeable battery connected to said on/off switch.

* * * * *